US005375353A

United States Patent [19]

Hulse

[11] Patent Number: 5,375,353

[45] Date of Patent: Dec. 27, 1994

[54] ILLUMINATED SIGN ASSEMBLY FOR A COMMUNICATION TOWER

[76] Inventor: James M. Hulse, 15905 W. 4B Rd., Plymouth, Ind. 46563

[21] Appl. No.: 74,884

[22] Filed: Jun. 10, 1993

[51] Int. Cl.[5] ..... G09F 21/06

[52] U.S. Cl. ..... 40/217; 40/541; 52/28; 343/721

[58] Field of Search ..... 40/603, 602, 606, 611, 40/217, 607, 610, 217, 541; 343/872, 874, 875, 890, 891, 721; 52/222, 28, 40, 652.1, 38, 103, 104, 28

[56] References Cited

U.S. PATENT DOCUMENTS

| | | | |
|---|---|---|---|
| D. 84,904 | 5/1931 | Tate | 40/217 |
| D. 84,905 | 5/1931 | Tate | 40/217 |
| 2,618,746 | 11/1952 | Pauch | 343/890 |
| 4,068,416 | 1/1978 | Decoppet | 52/40 |

FOREIGN PATENT DOCUMENTS

| | | | |
|---|---|---|---|
| 246469 | 8/1963 | Australia | 343/875 |

*Primary Examiner*—Kenneth J. Dorner
*Assistant Examiner*—Cassandra Davis
*Attorney, Agent, or Firm*—James D. Hall

[57] ABSTRACT

An illuminated sign assembly for use on a communications antenna tower. The sign assembly encloses the antenna tower. The sign assembly is mounted to the exterior of the antenna tower by paired support arms connected to the tower legs. The support arms provide an open area between the sign assembly and the tower face. A lighting panel is mounted to the exterior face of the tower within the open area. The sign assembly includes fabric side panels secured to side panel frames carried by the support arms and curved corner sections, which completely enclose the antenna tower.

6 Claims, 4 Drawing Sheets

SIGN
2
20
3
4
6
8
7

2
28
22
3.
3.
4.
4.
80
20
100
25
24
60
66
10
12
15
16
6
8
3
4
7

80
84
89
87
86
80

ILLUMINATED SIGN ASSEMBLY FOR A COMMUNICATION TOWER

This invention relates to a sign assembly used on communication towers and in particular an illuminated sign assembly that encircles the communication tower.

BACKGROUND OF THE INVENTION

The demand for cellular phones and other modern communication services has increased the need for additional telecommunications antenna towers. Telecommunications antenna towers must be specifically located in order to provide even signal coverage. Consequently, the acquisition of real estate for erecting communication towers has become a major concern for telecommunication service providers. Generally, land owners are unwilling to lease or sell small parcels of land for the erection of communications towers. Large metal communications towers are generally undesirable to residents and property owners and reduce the value of the surrounding properties. For these reasons, municipal zoning boards are inherently reluctant to grant zoning permits for the erection of communications towers.

Placing advertising signs on the sides of communications towers provides a potential benefit for the property owners. Typically, the signs are illuminated by front lighting, which shines on the face of the signs. The lights for the front illumination are sometimes placed upon the ground around the antenna tower, which increases the amount of real estate required. The ground lighting must be placed at a sufficient angle and distance to provide even lighting across the sign face. Even lighting is seldom achieved. In order to provide uniform illumination, back lit advertising sign panels have been developed. In back lit sign panels, the location of the light source is critical. If the light source is mounted within the protected framework of the tower, the cross members of the lattice cast shadows on the back of the sign panels. Most conventional back lit signs are single unit assemblies which are mounted directly to the communications tower. The single unit back lit signs are costly and expensive to service and replace.

SUMMARY OF THE INVENTION

The illuminated sign assembly of this invention eliminates the shadowing problems resulting from back lighting tower signs and reduces the expense of conventional single unit sign assemblies. The sign assembly of this invention uses the tower framework to support the lighting. The sign assembly of this invention completely encircles the tower and is spaced from the tower to allow the lights to be positioned between the tower and the sign panels. The lights are secured to the tower adjacently behind the sign panels to provide uniform lighting across the sign assembly.

Accordingly, an object of this invention is to provide for a novel and unique illuminated sign assembly adapted for use with a communications tower.

Another object is to provide for an illuminated sign assembly that completely encircles the communications tower.

Another object is to provide for an illuminated sign assembly with back lighting secured to a communications tower.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed, It is chosen and described to explain the principles of the invention and its application and practical use to enable others skilled in the art to utilize its teachings.

Figure 1:
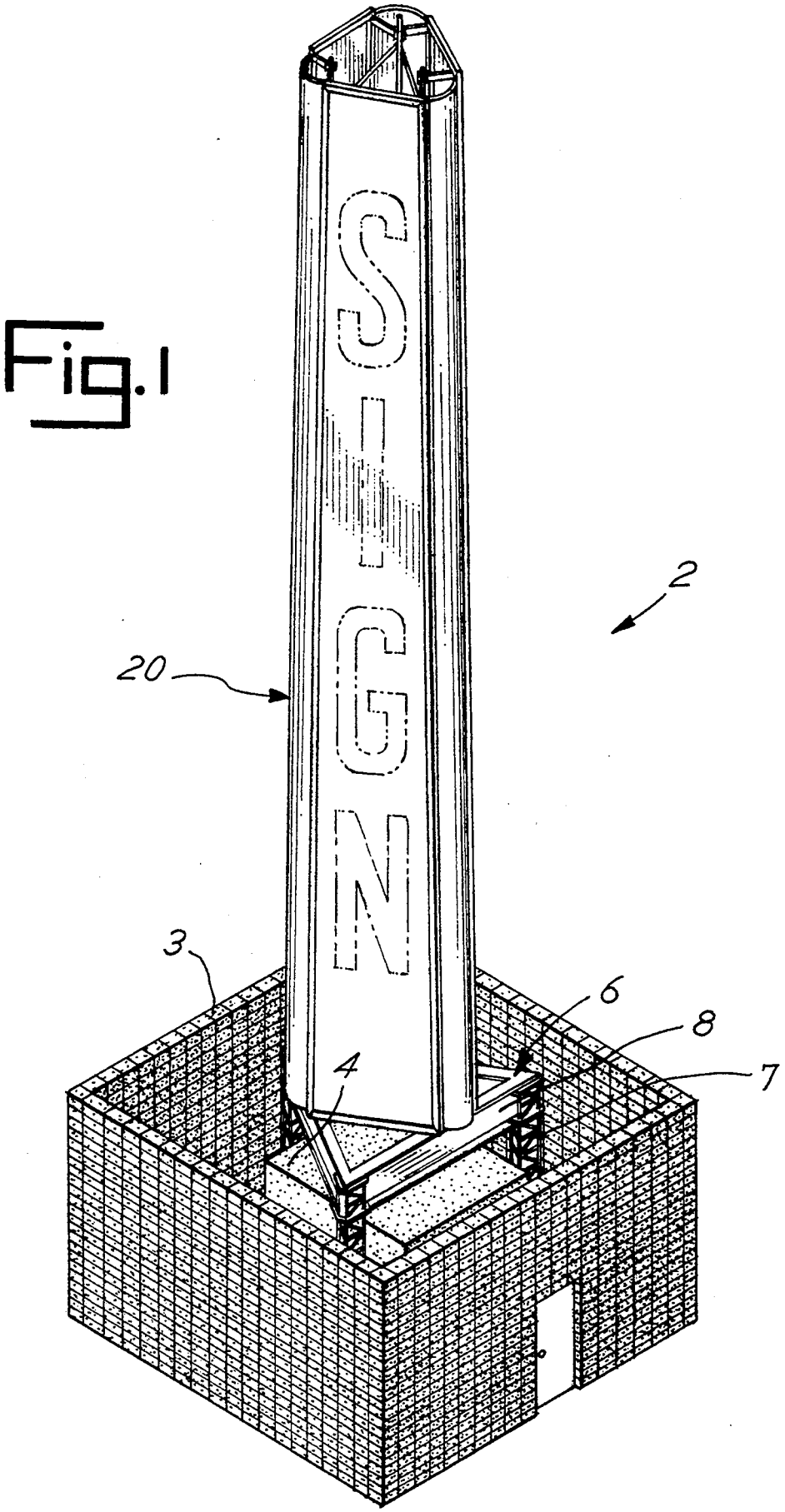
FIG. 1 is a perspective view of a communication tower station and the sign assembly of this invention.
Figure 2:
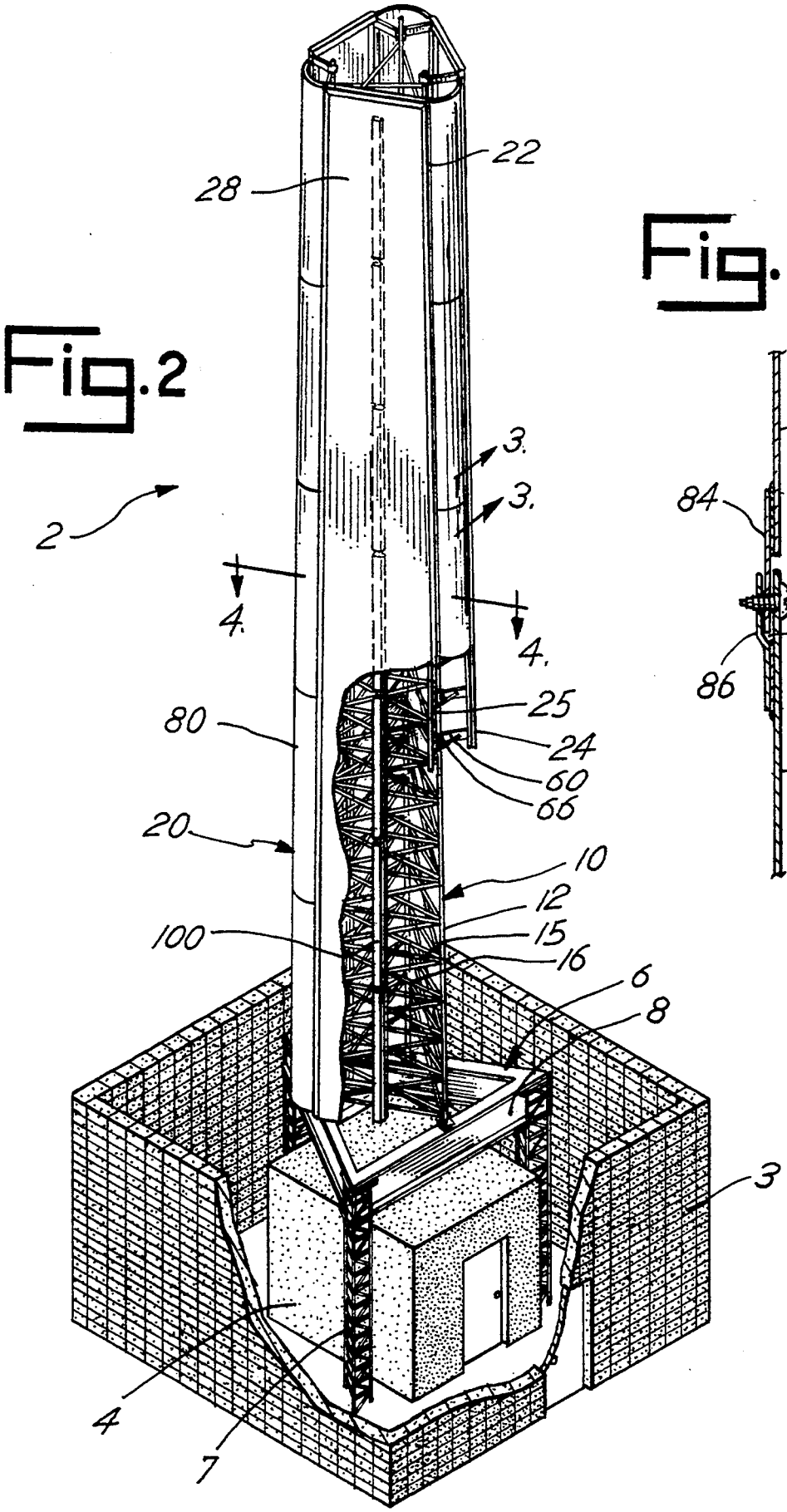
FIG. 2 is a perspective view of the communication tower station and the sign assembly with portions cut away to reveal the communication tower.
Figure 3:
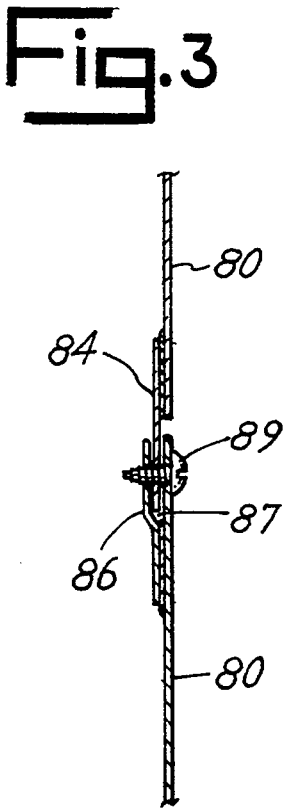
FIG. 3 is a detailed sectional view of the sign assembly taken along line 3—3 of FIG. 2.

FIGS. 1 and 2 show a conventional telecommunications tower station 2. Tower station 2 includes a communication building or shelter 4, tower base stand 6 and a communications tower 10. Federal regulations require that all tower stations be enclosed by a non-accessible fence or wall. Tower station 2 is enclosed by a conventional block wall 3. Shelter 4 houses the electronics for the communication equipment (not shown) supported by tower 10.

Tower 10 is similar to the towers manufactured by Pi-Rod, Inc. of Plymouth, Ind. Although tower 10 and base stand 6 are shown as a tri-pod, the sign assembly of this invention can be adapted for use with any conventional tower design. Also, tower 10 can be erected to any desirable height. Tower 10 has three tower legs 12, which extend vertically the entire height of the tower, and are mounted atop a tri-pod base stand 6. Base stand 6 straddles shelter 4. Base stand 6 has three vertical legs 7 that support three horizontal beams 8. Beams 8 are connected to form a level foundation upon which tower 10 is mounted. The lower end of each tower leg 12 is mounted to the mid point of a base beam 8. Tower legs 12 taper slightly inwardly towards the top of communications tower 10 and are connected and supported by horizontal support members 15 and diagonal cross braces 16. As a tri-pod, communications tower 10 has three vertical side faces 18. An antenna (not shown) will usually be carried at the top of the tower.

FIGS. 1–7 show the sign assembly 20 of this invention. Sign assembly 20 is mounted to and completely encircles the exterior of communications tower 10. Sign assembly 20 includes side panel frames 22 and spanning panel coverings 28, which overlie each tower face 18. Panel coverings 28 are generally elongated sheets of a weather resistant fabric, such as a vinyl covered polyester cloth with an outer coating of polyvinyl chloride (PVC). Each panel covering 28 is tightly secured at each end edge to a panel frame 22 to provide a smooth flat surface for displaying advertising messages or other decorative designs. In addition to the reduced weight, the fabric panel covering construction provides a translucent surface for illumination which is visible from great distances both during the day and night.

Figure 5:
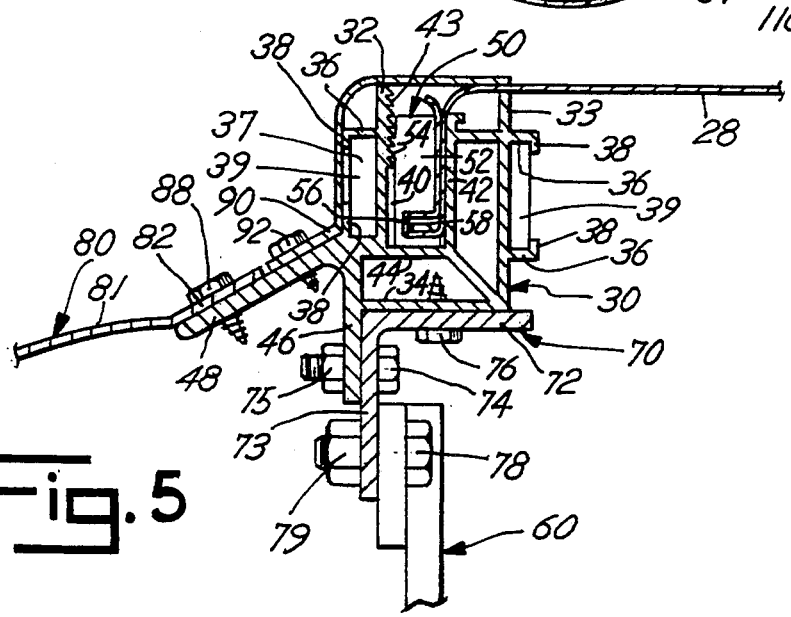
FIG. 5 is a detailed fragmented view of a portion of the sign assembly seen within broken line circle 5 of FIG. 4.
Figure 7:
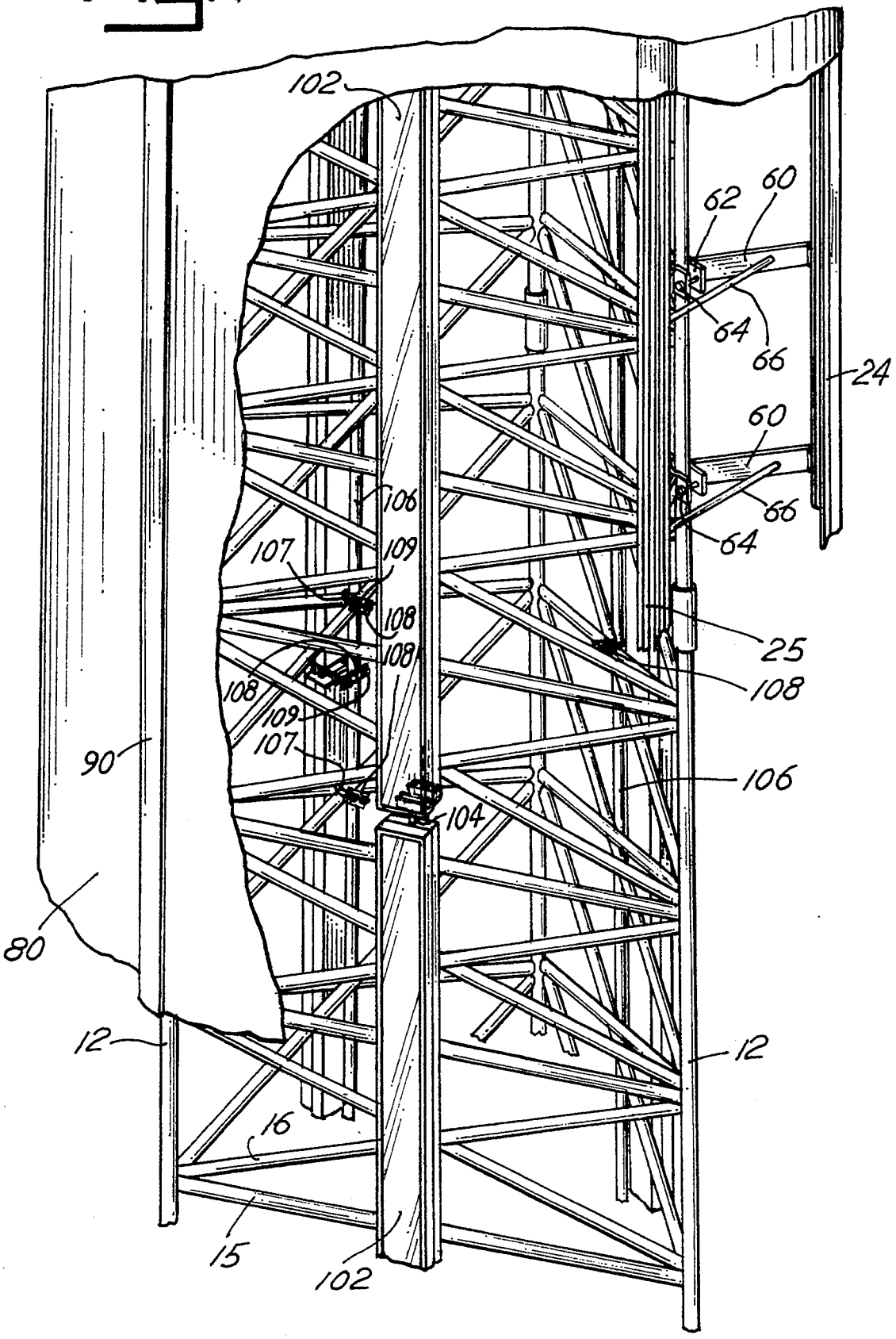
FIG. 7 is a perspective view of the communication tower and sign assembly with a portion cut away to review the lighting and its support arms.

Each side panel frame 22 includes two spaced parallel elongated side frame retainer parts or extrusions 24, 25 of mirror cross-sectional configurations. As shown in FIGS. 2 and 7, each side extrusion 24, 25 extends the entire height of tower 10 and is elongated sections of extruded metal, such as aluminum. Multiple sections of the frame extrusions can be connected end to end to provide the length necessary to reach the height of communications tower 10. FIG. 5 shows a cross section of a typical frame side extrusion. Each extrusion 24, 25 includes a main extrusion body 30 with two spaced outer side walls 32, 33, and an outer back wall 34. The exterior face of each outer side wall 32, 33 includes a pair of spaced flanges 36 which terminate in inturned opposed lips 38. Flanges 36 and inturned lips 38 define brace channels 37 in which support bars 39 are inserted to secure adjacent vertically aligned side extrusions in an end to end relation. The support bars 39 can be fastened within the brace channels of two side extensions by any conventional method such as screws. An intermediate wall 42 is located between outer side walls 32, 33 and is connected to an intermediate back wall 44. Outer side wall 32, intermediate wall 42 and intermediate back wall 44 define an end channel 40. The interior face of outer side wall 32 has a plurality of parallel toothed ribs 43 protruding into end channel 40. Channel ribs 43 run longitudinally the entire length of end channel 40. Extrusion body 30 also includes a back extension part 46 which protrudes from back wall 34, and a side extension part 48 which protrudes from outer side wall 32.

Figure 4:
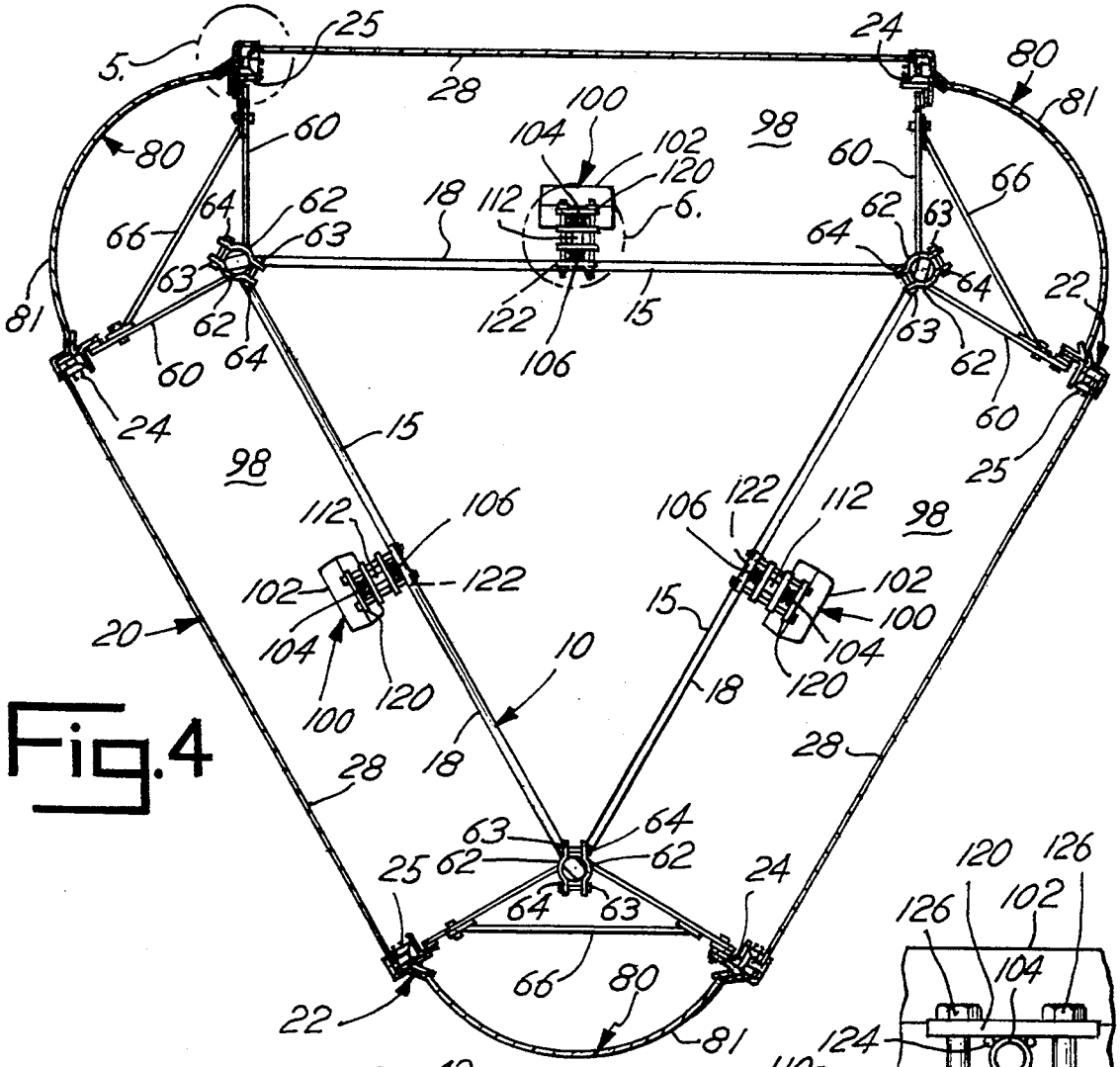
FIG. 4 is a cross sectional view of the communication tower and sign assembly taken along line 4—4 of FIG. 2.

As shown in FIG. 4, panel coverings 28 are fastened to panel frames 22. FIG. 5 shows panel covering 28 secured within end channel 40 of a frame extrusion 24, 25 by fastening clips 50 and clip bars 58, such as those manufactured by SignComp of Comstock Park, Mich. Fastening clips 50 and clip bars 58 can be constructed from a variety of suitable materials including thermoplastic resins, such as acrylonitrile-butadiene styrene (ABS) resin. Each fastening clip 50 has an elongated body 52 with a substantially rectangular cross section. The width of each fastener clip 50 is slightly less that the width of end channel 40. Each clip body 52 has teeth 54 and a longitudinal groove 56. Clip bar 58 is a substantially flat strip which is of equal length to clip body 52. Clip groove 56 is designed to accommodate clip bar 58.

As shown in FIG. 5, panel covering 28 is wrapped around clip bar 58 and inserted into clip groove 56. As shown in FIG. 5, a fastener clip 50 and the attached panel covering 28 are fitted into end channel 40 with panel covering 28 extending from the end channel between intermediate side wall 42 and the clip body. As fastener clips 50 are inserted deeper into end channels 40 across panel frame 22, panel covering 28 is drawn taut between frame extrusions 24, 25. The tension of panel covering 28 causes fastener clips 50 to pivot slightly within end channel 40. The rotation of fastening clip 50 urges side teeth 54 into engagement with ribs 43 of the frame extrusion. The engagement of teeth 54 and ribs 43 produces a ratcheting effect, which prevents fastener clips 50 from being pulled from end channel 40.

As shown in FIGS. 2, 4, 5 and 7, panel frames 22 are mounted to antenna tower 22 by a plurality of sign support arms 60. Support arms 60 are secured in pairs in spaced vertical orientation along the length of each tower leg 12. A mounting plate 62 is connected at an angle to one end of each support arm 60. As shown in FIG. 4, the paired support arms 60 are positioned on opposite sides of a tower leg 12 with mounting plates 62 straddling the tower leg. Paired support arms 60 are secured to tower leg 12 by a bolt 64 inserted through the mounting plates and affixed by a nut fastener 63. A cross brace 66 extends between each paired support arms 60. It should be noted that support arms 60 are substantially perpendicular to their adjacent tower face.

Side extrusions 24, 25 are connected to support arms 60 by an anglical mounting bracket 70. Mounting bracket 70 abuts back wall 34 and back extension part 46 of the side extrusion as shown. Bracket 70 is secured to back extension part 46 by a bolt 74 and nut fastener 75 and to back walls 34 by a self tapping screw 76. Each mounting bracket 70 is connected to a support arm 60 by a bolt 78 and nut fastener 79.

Corner panels 80 are connected between adjacent panel frames 22. As shown in FIGS. 1–5, multiple corner panels 80 are stacked end to end to span the entire height of panel frames 22. Corner panels 80 are elongated sheets of rolled metal, such as sheet aluminum and each is rolled to form a rounded convex outer surface 81 with flat edge flanges 82. The lower edge of each corner panel 80 has an inset flange part 84. The upper edges of each corner panel 80 includes an inset lip part 86, which forms a receiving channel 87 with surface 81. As shown, the flange part 84 of an upper corner panel 80 is seated within receiving channel 87 of the lower corner panel 80. This connection between the upper corner panel 80 and lower panel 80 is secured by a screw 89. The connection between adjacent corner panels 80 lends additional structural support to sign assembly 20 and prevents light from been seen through the seams between the corner panels. As shown in FIGS. 4 and 5, corner panels 80 are secured between the side extrusions of adjacent panel frames. Edge flanges 82 of each corner section 80 lie against side extension parts 48 of side extrusions 24, 25. Side flanges 82 are secured to side extension parts 48 by any conventional means such as self tap screws 88. The connection of panel covering 28 to panel frame 22 is covered by an outer molding 90. As shown in FIG. 5, outer molding 90 overlies end channel 40 and the exposed side of the side extrusion. Outer molding 90 provides a smooth outer appearance, as well as enclosing the extrusions of panel frame 22, and secured to side extension part 48 by any conventional method such as by self tap screws 92. With corner panels 80, panel frames 22 and panel coverings 28 secured in place, communications tower 10 is completely enclosed by sign assembly 20.

It should be noted that support arms 60 position sign assembly 20 in a spaced relation form the outer face of communications tower 10. The spacing of sign assembly and communications tower 10 forms an interior cavity 98, which accommodates the back lighting system 100. FIGS. 2, 4, 6 and 7 show the lighting system 100 for sign assembly 20. Lighting assembly 100 includes a column of connected vertical lighting panels 102. Light panels 102 are connected together in a vertical column by sections of metal conduits 104 extending from the ends of each lighting panel 102. Conduits 104 also provide channels for the electrical wiring of the lighting panels. As shown in FIG. 7, a lighting support pole 106 is located behind a lighting panel 102 at the center of each tower face 18. Each lighting support pole 106 is secured to tower support member 15 and cross braces 16 by U-bolts 107, fastener plates 108 and nut fasteners 109.

Figure 6:
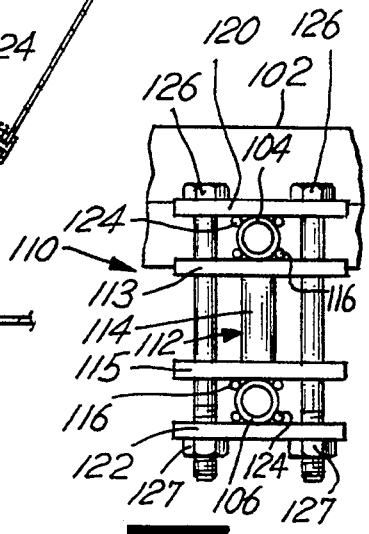
FIG. 6 is a detailed fragmented view of a portion of the sign assembly seen within broken line circle 6 of FIG. 4.

As shown in FIG. 6, lighting panels 102 are connected to the underlying support pole 106 by connector brackets 110. Lighting connector brackets 110 allow lighting panels to be slid or adjusted horizontally along the support pole for the desired illumination. Each lighting connector bracket 110 includes an H-shaped center part 112 and two end plates 120, 122. Center part 112 has two legs 113, 115 and a central cross member 114. Each leg 113, 115 has a hole at each end and a pair of spaced positioning parts 116, which are welded to the outer face of each leg 113, 115. Each end plate 120, 122 also has a hole at each end and a pair of spaced positioning parts 124, which are welded laterally to one of its faces. As shown in FIG. 6, a pair of bolts 126 extend through end plates 120, legs 113, 115, and end plate 122 and are affixed to nut 127. As shown, positioning parts 124 of end plates 120, 122 face positioning parts 116 of center part 112 so that conduit 104 and support pole 106 can be clamped between the positioning parts of the center part and end plates. With conduit 104 and support pole 106 positioned within lighting connector brackets 110, bolts 126 can be drawn down to secure each lighting panel 102 to a support pole 106.

In this manner, the lighting panels can be connected and secured along the height of each tower face. The lighting assembly is supported by the tower framework, but completely enclosed by sign assembly 20. Securing the lighting assembly to the exterior of the communications tower eliminates the shadowing effects on the sign assembly while taking advantage of the towers structural support. Cavity 98 also provides ample space for an installer or repairman during assembly or in the event that a lighting panel needs to be replaced.

It is understood that the above description does not limit the invention to the details given, but may be modified within the scope of the following claims.

I claim:

1. A sign assembly in combination with a tower having at least two side faces, said sign assembly comprising:

a side panel overlying each of said side faces and including vertical edges, corner means connected to said side panel edges for enclosing sign assembly around said tower, and mounting means extending between and connecting said sign assembly and said tower for spacing each side panel and said corner means from said tower, and lighting means located between said tower and at least one said side panel for illuminating said one side panel.

2. A sign assembly in combination with a tower having at least two side faces, said sign assembly comprising:

a side panel overlying each of said side faces and including vertical edges, corner means connected to said side panel edges for enclosing said sign assembly around said tower, and mounting means extending between and connecting said sign assembly and said tower for spacing each side panel and said corner means from said tower, each sign panel having a back side facing a side face, and lighting means including a light source mounted to said tower and directed to illuminate the back side of at least one said side panel.

3. A sign assembly in combination with a tower having at least two side faces, said sign assembly comprising:

a side panel overlying each of said side faces and including vertical edges, corner means connected to said side panel edges for enclosing said sign assembly around said tower, and mounting means extending between and connecting said sign assembly and said tower for spacing each side panel and said corner means from said tower, each side panel including panel frame and panel covering connected to panel frame.

4. The sign assembly of claim 3 wherein said mounting means includes support arms connected at one end thereof to said tower and at the opposite end thereof to said panel frame.

5. The sign assembly of claim 4 wherein said panel frame includes a pair of spaced elongated vertical retainer parts, said panel covering means connected between said retainer parts, thereby overlying said tower face.

6. The sign assembly of claim 5 wherein said corner means includes an elongated corner panel connected to each retainer part.

* * * * *